United States Patent [19]

Yuasa

[11] Patent Number: 4,586,807

[45] Date of Patent: May 6, 1986

[54] TRANSFER-TYPE ELECTROSTATIC RECORDING METHOD

[75] Inventor: Kazuhiro Yuasa, Zama, Japan

[73] Assignee: Ricoh Company, Ltd., Japan

[21] Appl. No.: 590,849

[22] Filed: Mar. 19, 1984

[30] Foreign Application Priority Data

Mar. 19, 1983 [JP] Japan ..... 58-45320

[51] Int. Cl.[4] ..... G03G 15/00

[52] U.S. Cl. ..... 355/3 BE; 355/16

[58] Field of Search ..... 355/3 BE, 3 DR, 16, 355/3 DD

[56] References Cited

U.S. PATENT DOCUMENTS 3,976,375 8/1976 Kurita et al. ..... 355/16

4,395,112 7/1983 Miyakawa et al. ..... 355/3 DD

*Primary Examiner*—Arthur T. Grimley

*Assistant Examiner*—David S. Warren

*Attorney, Agent, or Firm*—Guy W. Shoup

[57] ABSTRACT

An electrostatic recording method for first forming a developed image on an endless imaging belt and then transferring the developed image to a transfer medium is provided. The endless imaging belt includes an excessively high resistance region in the vicinity of its seam and the image transfer step is held inoperative at least while this region is moving through a developing station.

8 Claims, 4 Drawing Figures

TRANSFER-TYPE ELECTROSTATIC RECORDING METHOD

BACKGROUND OF THE INVENTION

1. Field of the Invention

This invention generally relates to a method for recording an image on a transfer medium by first forming an image on an imaging surface and then having the image transferred to a transfer medium and in particular to a transfer-type electrostatic recording method using an endless imaging belt.

2. Description of the Prior Art

FIG. 1 shows a typical electrostatic recording system of the image transfer type. As shown, the system includes an endless imaging belt 1 which comprises a supporting layer 1*a*, an electrically conductive layer 1*b* and a dielectric layer 1*c* as formed one on another in the order mentioned from the inner side to the outer side, and the imaging belt 1 is provided as extending around a plurality of rollers 2, thereby allowing to advance in the direction indicated by the arrow. The electrically conductive layer 1*b* is connected to ground through a ground brush (not shown) which is disposed to be in sliding contact with a side periphery of the conductive layer 1*b*. Around the outer periphery of the imaging belt 1 and along the direction of advancement thereof are disposed a charger 3 for uniformly charging the outer peripheral surface of the belt 1 to a predetermined polarity, a recording unit 4 for forming an electrostatic latent image on the belt 1, a developing device 5 for developing the latent image into a visible image, an image transfer device 6 for transferring the developed image to a transfer medium 8 and a cleaning device 7 for cleaning the belt 1. Thus, the outer peripheral surface of the belt 1 defines an imaging surface which is subjected to various image forming processes by the above-mentioned devices while the belt 1 completes one cycle of revolution.

In order to transfer the developed image to a transfer medium in the above-described recording system, the image transfer device 6 comprised of a corona unit applies corona ions having a polarity opposite to the polarity of the developer to a back side of the transfer medium 8 thereby causing the developer defining a desired image to be transferred from the belt 1 to the transfer medium 8. For this purpose, a negative high voltage is applied to the image transfer corona unit 6. During such an image transfer operation, no particular problems arise as long as an electrical resistance of the electrically conductive layer 1*b* is as small as negligible because the entire electrically conductive layer 1*b* may be maintained substantially at the ground level at all times thereby allowing to prevent the image forming process from being adversely affected by the operation at the image transfer station.

On the other hand, in the case where the resistance of the conductive layer 1*b* is appreciably high, there is produced a voltage drop in accordance therewith. A representative relation between sheet resistance $\rho_c$ (resistance value per unit area) of conductive layer 1*b* and voltage drop $\Delta V$ of applied voltage for image transfer is shown in FIG. 2 as a semi-logarithmic graph. If the voltage drop $\Delta V$ exceeds a developing threshold voltage, charged toner will be attracted to the imaging surface uniformly, i.e., so-called "blanket development", thereby causing background contamination and a deterioration in image quality.

In order to cope with the above-described situation, the electrically conductive layer 1*b* may be structured to have sheet resistance $\rho_c$ such that the voltage drop $\Delta V$ does not exceed the developing threshold voltage. Supposing that an allowable limit for such a voltage drop $\Delta V$ is 10 V, then the corresponding allowable limit for sheet resistance $\rho_{cL}$ becomes approximately $5\times10^7$ ohms/□ as indicated in the graph of FIG. 2.

However, even if the electrically conductive layer 1*b* itself is structured such that its sheet resistance $\rho_c$ is lower than the above-mentioned sheet resistance allowable limit $\rho_{cL}$, there is normally formed a locally high electrical resistance region in the vicinity of a seam C which is inevitably formed when fabricating the imaging belt in an endless form unless a sophisticated, expensive fabricating method is used.

FIG. 3 is a graph showing a distribution of resistance to ground $R_e$ of belt 1 along its travelling direction with the abscissa taken for a distance y measured from the seam C along the travelling direction of the belt 1 and the ordinate taken for resistance to ground $R_e$. It is to be noted that $l_0$ indicates a circumferential length of the belt 1. It is seen in the graph of FIG. 3 that the resistance is higher in the vicinity of the seam C and it exceeds the resistance allowable limit $R_{eL}$ which corresponds to the sheet resistance allowable limit $\rho_{cL}$, as indicated by the dotted line. Accordingly, if the image transfer corona unit 6 is on while the seam C and its periphery is moving through a developing station, the before-mentioned "blanket development" would take place at the seam C and its vicinity. This is because, the potential level at the imaging surface of belt 1 fluctuates due to the application of corona ions at the image transfer station while the seam C and its vicinity is passing through the developing station including a developing roller 5*a* which is maintained at a predetermined developing voltage.

SUMMARY OF THE INVENTION

It is therefore a primary object of the present invention to provide an improved electrostatic recording method by obviating the disadvantages of the prior art as described above.

Another object of the present invention is to provide an improved image transfer type electrostatic recording method using an endless imaging belt.

A further object of the present invention is to provide an image transfer type electrostatic recording method capable of forming a desired image excellent and uniform in quality without causing local background contamination.

Other objects, advantages and novel features of the present invention will become apparent from the following detailed description of the invention when considered in conjunction with the accompanying drawings.

DESCRIPTION OF THE PREFERRED EMBODIMENTS

Figure 4:
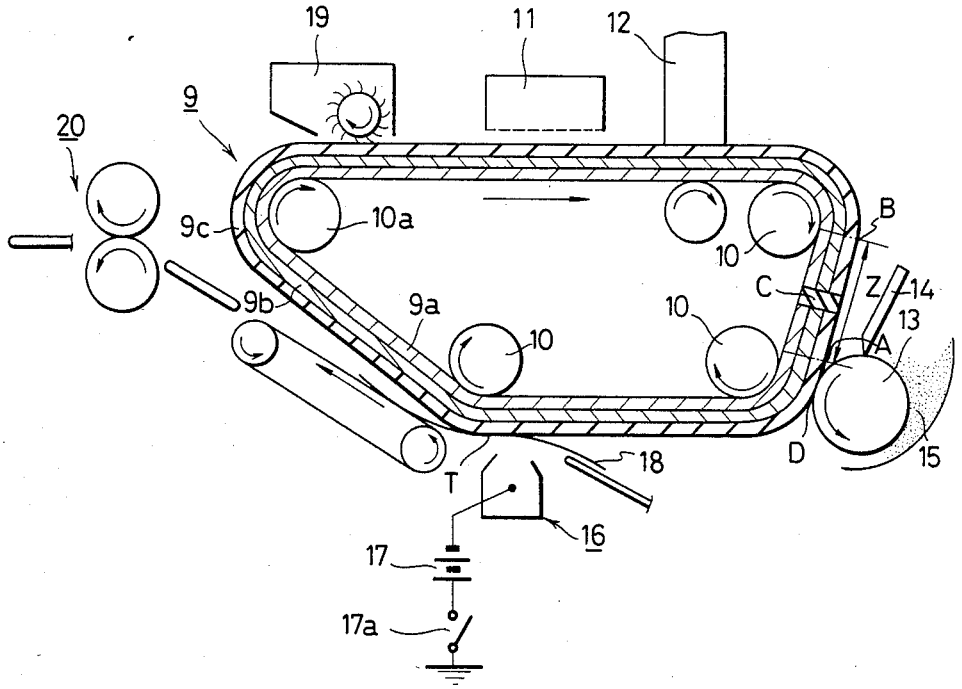
FIG. 4 is a schematic illustration showing an image transfer type electrostatic recording system capable of carrying out the present method.

Referring now to FIG. 4, there is shown an image transfer type electrostatic recording system which has been constructed on the basis of the present invention. Although the present invention should not be limited only to this, it will be assumed that the system shown in FIG. 4 carries out the so-called reverse development in which a charge pattern is formed on an imaging surface by the charge having the same polarity as that of toner to be applied to the imaging surface for forming a visible image. As shown in FIG. 4, an endless imaging belt 9 is provided as extending around a plurality of rollers 10 so that it advances in the direction indicated by the arrow when one of the rollers 10 is driven to rotate. In the illustrated embodiment, the endless imaging belt 9 includes a supporting or base layer 9*a*, an electrically conductive layer 9*b* formed on the supporting layer 9*a* and a dielectric layer 9*c* formed on the conductive layer 9*b*, whose outer surface defines an imaging surface on which a desired image is formed. The electrically conductive layer 9*b* is structured to have a sheet resistance $\rho_c$ to be lower than the allowable limit $\rho_{cL}$ as described above; however, since it is connected on both ends to define an endless loop, there is formed a seam C at the connection so that the resistance is higher at the seam C and its vicinity as compared with the remaining portion of the conductive layer 9*b*. It is to be noted that the electrically conductive layer 9*b* must be connected to a reference potential, i.e., ground potential in the illustrated embodiment, so that the conductive layer 9*b* is, in fact, connected to ground through a ground brush (not shown) as well known in the art.

A corona charging device 11 is disposed opposite to the imaging surface of the endless belt 9 so that the imaging surface is charged to a predetermined polarity, positive polarity in the illustrated example, uniformly as the belt 9 advances. Downstream of the charging device 11 with respect to the direction of advancement of the belt 9 is disposed a multistylus recording head 12 including an array of styluses which are selectively activated in accordance with an image signal supplied thereto thereby selectively dissipating the charge on the belt 9 to form an electrostatic latent image in the form of a negative image.

Further downstream of the multistylus recording head 12 is disposed a developing roller 13 which is supported to be driven to rotate in rolling contact with the imaging surface of the endless imaging belt 9. Although not shown specifically, it is to be noted that a bias voltage source, for example, of the polarity same as that of the uniform charge is provided to apply a developing bias between the belt 9 and the roller 13. A developing region D is defined between the developing roller 13 and the belt 9, where a developing agent 15, such as toner, is selectively transferred to the imaging surface of the belt 9 to visualize the latent image. For this purpose, a doctor blade 14 is disposed with its tip end pressed against or in the vicinity of the roller 13 so that a thin film of developing agent 15 is formed on the peripheral surface of the roller 13 as the roller 13 is driven to rotate in the direction indicated by the arrow. While the developing agent 15 is formed into a thin film, it is also charged to a predetermined polarity, positive polarity which is the same polarity as that of the uniform charge in the illustrated example. Thus, when the thus formed thin film of charged developing agent 15 is brought closer to the latent image formed on the belt 9, the developing agent 15 is transferred to those portions of the belt 9 from where the charge has been eliminated by the multistylus recording head 12. Thus, the so-called reverse development is carried out.

Further downstream of the developing region D is disposed an image transfer corona unit 16. Also provided as connected to a corona wire of the image transfer corona unit 16 is a voltage source 17 which applies a negative high voltage to the corona wire and which is also connected to ground through a switch 17*a*. Accordingly, since the developed image is formed by the positively charged developing agent, when a negative high voltage is applied to the transfer corona unit 16 by closing the switch 17*a*, negative corona ions are deposited on a back side of a transfer medium 18 which is temporarily brought into contact with the belt 9 at an image transfer region T so that the developed image formed by the positively charged developing agent becomes transferred to the transfer medium 18 due to electrostatic attraction. Further downstream of the transfer region T is provided a cleaning device 19 for removing the non-transferred developing agent remaining on the belt 9. On the other hand, there is defined a transporting path leading from the image transfer region T to an image fixing device 20 so that the transfer medium 18, after having been separated from the belt 9, is transported to the image fixing device 20 where the transferred image is fixed to the transfer medium 18. As is well known in the art, another corona unit may be disposed between the cleaning unit 19 and the corona charger 11 for removing any residual charge on the belt 9.

With the above-described structure, in accordance with the present invention, an excessively high electrical resistance region Z where resistance $R_e$ to ground exceeds a predetermined allowable resistance limit $R_{eL}$ is determined along the belt 9 and the image transfer corona unit 16 is held inoperative at least while this region Z is moving past the developing region D. With such a mode of operation applied to the electrostatic recording system shown in FIG. 4, the before-mentioned "blanket development" may be prevented from occurring.

The remaining region of the belt 9, which is a region defined by removing the region Z from the entire circumferential region of the belt 9, has an electrical resistance below the allowable limit $R_{eL}$ and will be called a proper resistance region Y. It will now be described as to how this proper resistance region Y is determined. First, designating an allowable limit value in sheet resistance of electrically conductive layer 9*b* by $\rho_{cL}$, the corresponding allowable limit value of resistance to ground $R_{eL}$ may be expressed as follows:

$$R_{eL} = k \frac{l_1 \sqrt{l_0^2 + l_1^2}}{8} \cdot \rho_{cL} \tag{1}$$

where, $l_0$: circumferential length of belt 9, $l_1$: width of belt 9, and k: constant.

On the other hand, designating the sheet resistance of the electrically conductive layer 9b by $\rho_c$, resistance $R_e$ at a position separated away from the seam C by a distance y may be expressed as follows:

$$R_e = \frac{k \cdot \rho_c}{4\left\{\frac{y}{l_1\sqrt{y^2 + l^2/4}} + \frac{l_0 - y}{l_1\sqrt{(l_0 - y)^2 + l_1^2/4}}\right\}} \quad (2)$$

Thus, the proper resistance region Y may be determined by finding a condition which satisfies the following relation.

$$R_e < R_{eL} \quad (3)$$

That is, $$\frac{y}{\sqrt{y^2 + l_1^2/4}} + \frac{l_0 - y}{\sqrt{(l_0 - y)^2 + l_1^2/4}} > \frac{2l_0}{\sqrt{l_0^2 + l_1^2}} \cdot \frac{\rho_c}{\rho_{cL}} \quad (4)$$

Figure 1:
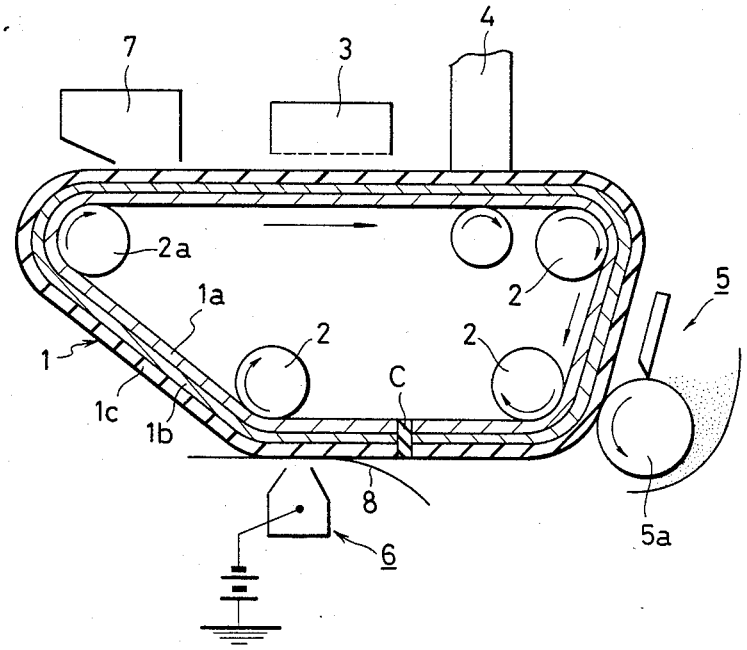
FIG. 1 is a schematic illustration showing a typical image transfer type electrostatic recording system using an endless imaging belt to which the present invention may be advantageously applied.
Figure 2:
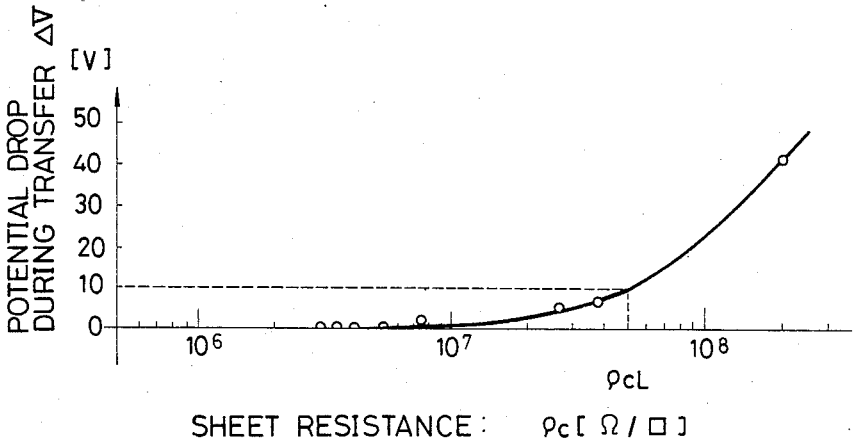
FIG. 2 is a graph showing a relation between sheet resistance and voltage drop plotted in a semi-log format.
Figure 3:
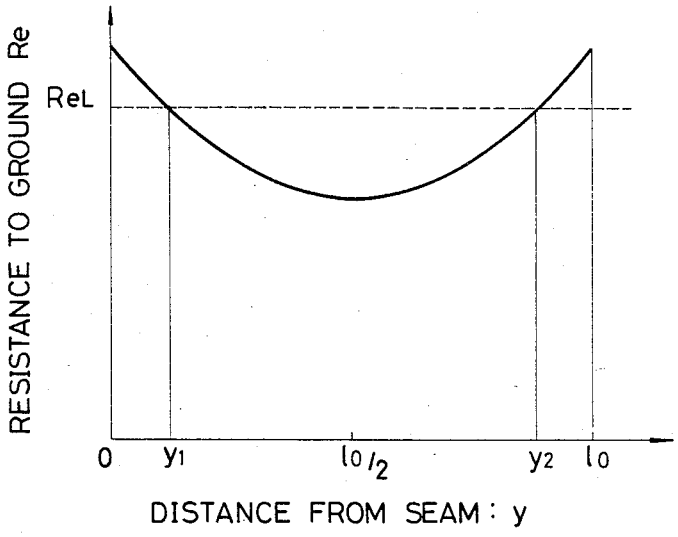
FIG. 3 is a graph showing a distribution of electrical resistance $R_e$ along the length of the endless imaging belt 1 used in the system shown in FIG. 1.

Now, as indicated in the graph of FIG. 3, designating intersections between the solid line of $R_e$ and the dotted line of $R_{eL}$ by $y_1$ and $y_2$, the above relation (4) may be modified as $$y_1 < y < y_2 \quad (5)$$

so, the proper resistance region Y is determined as y in the above relation (5).

Returning to FIG. 4, the operation of the illustrated recording system in accordance with the present invention will be described. With the proper resistance region Y thus determined, boundary positions A and B of the proper resistance region Y as spaced apart from the seam C over distances $y_1$ and $y_2$ along the circumferential distance of the belt 9 are specified. As the belt 9 is driven to advance in the direction indicated by the arrow, the imaging surface of the belt 9 is uniformly charged to positive polarity by means of the corona charger 11 and the uniform charge is selectively dissipated by the multistylus recording head 11 to form an electrostatic latent image in the form of a negative image. The latent image is then moved to the developing region D where the positively charged developing agent 15 is applied by the developing roller 13 so that the latent image is developed in a reverse development mode.

When the leading boundary position A approaches or arrives at the developing region D, the switch 17a is opened to set the image transfer corona unit 16 inoperative. It is to be noted that any other means than the switch 17a may, of course, be used to set the corona unit 16 inoperative. The corona unit 16 is kept inoperative until the trailing boundary position B arrives at the developing region D or a predetermined time has elapsed thereafter. In this manner, in accordance with the present invention, the image transfer corona unit 16 is held inoperative at least while the improper resistance region Z is moving through the developing region D and other than that the image transfer corona unit 16 is kept operative. As a result, even if the belt 9 has a portion whose electrical resistance exceeds a predetermined allowable limit, no "blanket development" takes place and thus no background contamination will occur.

The developed image, on the other hand, is then transported to the image transfer region T where the developed image is transferred to the transfer medium 18 because negatively charged corona ions are deposited to the back side of the transfer medium 18 from the corona unit 16. Then, the imaging surface of the belt 9 is cleaned by the cleaning device 19 so that any residual developing agent on the imaging surface may be removed, thereby preparing the imaging surface ready for the next cycle of operation. On the other hand, the transfer medium 18 bearing thereon the transferred image is transported through the image fixing device 20 where the transferred image is fixed to the transfer medium 18, for example, thermally, and, then, the transfer medium 18 is discharged to a tray.

While the above provides a full and complete disclosure of the preferred embodiments of the present invention, various modifications, alternate constructions and equivalents may be employed without departing from the true spirit and scope of the invention. For example, in the above-described embodiment, use is made of reverse development; however, use may also be made of normal development in which a positive-to-positive development is carried out. In addition, the present invention is also applicable to an imaging belt which includes a photosensitive layer, such as an organic photoconductor layer, in place of the dielectric imaging layer 9c in the above-described embodiment. Therefore, the above description and illustration should not be construed as limiting the scope of the invention, which is defined by the appended claims.

What is claimed is:

1. An imaging method comprising the steps of:

forming an electrostatic latent image on an imaging member which moves along a predetermined path, said imaging member including a specified region whose electrical resistance exceeds a predetermined allowable limit:

developing said latent image by applying a developing agent thereto to form a developed image in a developing region defined along said predetermined path; and transferring said developed image to a transfer medium in an image transfer region defined along said predetermined path, whereby said transferring step is held inoperative at least while said specified region moves through said developing region.

2. The method of claim 1 wherein said developing step is carried out by a developing roller with a bias applied between said imaging member and said roller.

3. The method of claim 2 wherein said transferring step is carried out by a corona unit which applies corona ions opposite in polarity to said developed image to a back side of said transfer medium at said image transfer region.

4. The method of claim 3 wherein a switch is connected to said corona unit and said switch is turned on and off in association with the positional relation between said specified region and said developing region as said imaging member advances.

5. The method of claim 1 wherein said imaging member is in an endless form and travels along said predetermined path in a cyclic manner.

6. The method of claim 5 wherein said imaging member includes an electrically conductive layer and a dielectric layer formed on said electrically conductive layer with said electrically conductive layer connected to a reference potential.

7. The method of claim 6 wherein said reference potential is ground.

8. The method of claim 7 wherein said endless imaging member is in the shape of an endless belt formed by connecting both ends thereby defining a seam and having a circumferential length $l_0$ and a width $l_1$ and, designating sheet resistance of said electrically conductive layer by $\rho_c$ and an allowable limit in such sheet resistance by $\rho_{cL}$, said specified region is determined by a following relation with a distance from said seam in the advancing direction of said imaging member designated by y, $$\frac{y}{\sqrt{y^2 + l_1^2/4}} + \frac{l_0 - y}{\sqrt{(l_0 - y)^2 + l_1^2/4}} \leqq \frac{2l_0}{\sqrt{l_0^2 + l_1^2}} \cdot \frac{\rho_c}{\rho_{cL}}.$$

* * * * *